US009419362B2

(12) United States Patent
Lin

(10) Patent No.: US 9,419,362 B2
(45) Date of Patent: Aug. 16, 2016

(54) ELECTRICAL RECEPTACLE CONNECTOR

(71) Applicant: FOXCONN INTERCONNECT TECHNOLOGY LIMITED, Grand Cayman (KY)

(72) Inventor: Min-Han Lin, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/812,074

(22) Filed: Jul. 29, 2015

(65) Prior Publication Data

US 2016/0043518 A1 Feb. 11, 2016

(30) Foreign Application Priority Data

Aug. 6, 2014 (TW) ..... 103126876 A
Aug. 15, 2014 (TW) ..... 103128035 A

(51) Int. Cl.
*H01R 13/193* (2006.01)
*H01R 13/453* (2006.01)
*H01R 24/60* (2011.01)

(52) U.S. Cl.
CPC ..... *H01R 13/193* (2013.01); *H01R 13/4538* (2013.01); *H01R 24/60* (2013.01)

(58) Field of Classification Search
CPC ..... H01R 13/4538
USPC ..... 439/139, 140
See application file for complete search history.

(56) References Cited

U.S. PATENT DOCUMENTS 4,445,739 A * 5/1984 Wooten ..... H01R 13/4538 439/140
5,167,516 A * 12/1992 Tan ..... H01R 13/631 439/140
5,779,491 A * 7/1998 Nagano ..... H01R 13/629 439/141
5,964,600 A * 10/1999 Miles ..... H01R 13/4538 439/138
6,106,335 A * 8/2000 Merchant ..... H01R 13/506 439/620.23
6,206,577 B1 * 3/2001 Hall, III ..... G02B 6/3825 385/53
6,375,480 B1 * 4/2002 Chen ..... H01R 13/447 439/142

(Continued)

FOREIGN PATENT DOCUMENTS

TW M343289 10/2008
TW I396347 5/2013

*Primary Examiner* — Ross Gushi
(74) *Attorney, Agent, or Firm* — Ming Chieh Chang; Wei Te Chung

(57) ABSTRACT

A receptacle connector (100) includes an insulative housing (1) defining an inner space (10), an insulative body (4) assembled to the insulative housing, a slider (2) assembled between the insulative housing and the insulative body along a front-and-rear direction, and a number of terminals (3) retained in the insulative body. Each terminal has a contacting portion (32), a U-shaped portion (31), and a slantwise linear portion (32) connecting between the contacting portion and the U-shaped portion. The U-shaped portion is retained in the insulative body and partly exposing out of the insulative body. The contacting portion is suspended upon the slider. The slider moves in the inner space from a front, original position to a back, final position, presses against the U-shaped portions and pulls the slantwise linear portions downwardly. Finally, the contacting portions enter into the inner space for engaging with a mating plug connector.

20 Claims, 12 Drawing Sheets

(56) References Cited

U.S. PATENT DOCUMENTS 6,685,362 B2 * 2/2004 Burkholder ..... G02B 6/3849 385/78
6,733,311 B2 * 5/2004 Kameda ..... H01R 13/4538 439/140
6,866,535 B2 * 3/2005 Uchida ..... H01R 13/6275 439/357
6,869,297 B2 * 3/2005 Caveney ..... H01R 13/4536 439/138
6,877,999 B2 * 4/2005 Hashimoto ..... H01R 13/4532 439/138
6,935,873 B2 * 8/2005 Funatsu ..... H01R 13/4532 439/137
6,942,503 B2 * 9/2005 Yamaguchi ..... H01R 13/6485 439/140
6,951,469 B1 * 10/2005 Lin ..... H01R 13/4538 439/135
6,955,546 B1 * 10/2005 Huang ..... H01R 13/5213 439/135
6,971,891 B1 * 12/2005 Huang ..... H01R 13/4536 439/137
7,086,880 B2 * 8/2006 Uchida ..... H01R 13/4538 439/141
7,125,269 B2 * 10/2006 Ohta ..... H01R 13/4538 439/140
7,134,888 B2 * 11/2006 Fan ..... H01R 13/4538 439/137
7,140,891 B1 * 11/2006 Huang ..... H01R 12/716 439/137
7,140,892 B2 * 11/2006 Takeuchi ..... H01R 13/6583 439/138
7,144,163 B2 * 12/2006 Tanaka ..... G02B 6/3825 385/55
7,150,636 B2 * 12/2006 Zhu ..... H01R 13/4538 439/141
7,223,108 B2 * 5/2007 Chiang ..... H01R 13/4538 439/137
7,357,653 B2 * 4/2008 Hung ..... G06K 7/0034 439/138
7,364,444 B2 * 4/2008 Kellock ..... H01R 13/4536 439/138
7,661,990 B1 * 2/2010 Chiang ..... H01R 13/6582 439/607.35
7,717,626 B2 * 5/2010 Cheng ..... G02B 6/3849 385/139
7,744,388 B2 * 6/2010 Lee ..... H01R 13/4538 439/144
7,766,677 B2 * 8/2010 Chiang ..... H01R 13/5213 439/140
8,075,325 B1 * 12/2011 Kao ..... H01R 13/5213 438/141
8,172,579 B2 * 5/2012 Pan ..... H01R 13/5213 439/38
8,353,711 B2 * 1/2013 Huang ..... H01R 13/4536 439/138
8,376,786 B2 * 2/2013 Carreras Garcia ... H01R 13/187 439/382
8,465,304 B2 * 6/2013 Yen ..... H01R 13/4538 439/131
8,702,435 B2 * 4/2014 Tajima ..... H01R 13/4538 439/140
8,827,726 B2 * 9/2014 Chen ..... H01R 13/502 439/144
8,882,518 B2 * 11/2014 Li ..... H01R 13/4538 439/141
9,028,264 B2 * 5/2015 Head ..... H01R 13/00 439/140
9,196,997 B2 * 11/2015 Sanders ..... G02B 6/3849
2001/0031570 A1 * 10/2001 Horikoshi ..... H01R 13/4532 439/137
2003/0077929 A1 * 4/2003 Funatsu ..... H01R 13/4532 439/137
2003/0119348 A1 * 6/2003 Kameda ..... H01R 13/4538 439/137
2003/0119349 A1 * 6/2003 Bakker ..... H01R 13/4538 439/140
2004/0166711 A1 * 8/2004 Uchida ..... H01R 13/6275 439/140
2004/0229484 A1 * 11/2004 Uchida ..... H01R 13/4538 439/137
2005/0164544 A1 * 7/2005 Yamaguchi ..... H01R 13/6485 439/495
2007/0167076 A1 * 7/2007 Seh ..... H01R 13/4538 439/607.01
2016/0043518 A1 * 2/2016 Lin ..... H01R 13/193 439/676

* cited by examiner

ELECTRICAL RECEPTACLE CONNECTOR

BACKGROUND OF THE INVENTION

1. Field of the Invention

The present invention relates generally to a receptacle connector, and more particularly to a receptacle connector effectively engaged with a mating plug connector.

2. Description of Related Arts

A plug connector comprises a mating tongue and a plurality of plug contacts exposed on both upper and lower sides of the mating tongue. A receptacle connector defines a receiving space and has both receptacle contacts and a pair of latches extending into the receiving space for engaging with the plug contacts when the plug connector is inserted in the receiving space of the receptacle connector. The mating tongue undertakes obstruction both from the receptacle contacts and the latches during insertion of the plug connector which may increase difficulty in operation for the user. After repeated use, the plug connector may not be so effectively engaged with the receptacle connector by merely the retaining forces between the plug contacts and the receptacle contacts/latches.

A receptacle connector providing enduring retaining force to a plug connector is desired.

SUMMARY OF THE INVENTION

Accordingly, an object of the present invention is to provide a receptacle connector providing enduring retaining force to a plug connector.

To achieve the above object, a receptacle connector includes an insulative housing defining an inner space, an insulative body assembled to the insulative housing, a slider assembled between the insulative housing and the insulative body along a front-and-rear direction, and a number of terminals retained in the insulative body. Each terminal has a contacting portion, a U-shaped portion, and a slantwise linear portion connecting between the contacting portion and the U-shaped portion. The U-shaped portion is retained in the insulative body and partly exposing out of the insulative body. The contacting portion is suspended upon the slider. The slider moves in the inner space from a front, original position to a back, final position, presses against the U-shaped portions and pulls the slantwise linear portions downwardly. Finally, the contacting portions enter into the inner space for engaging with a mating plug connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
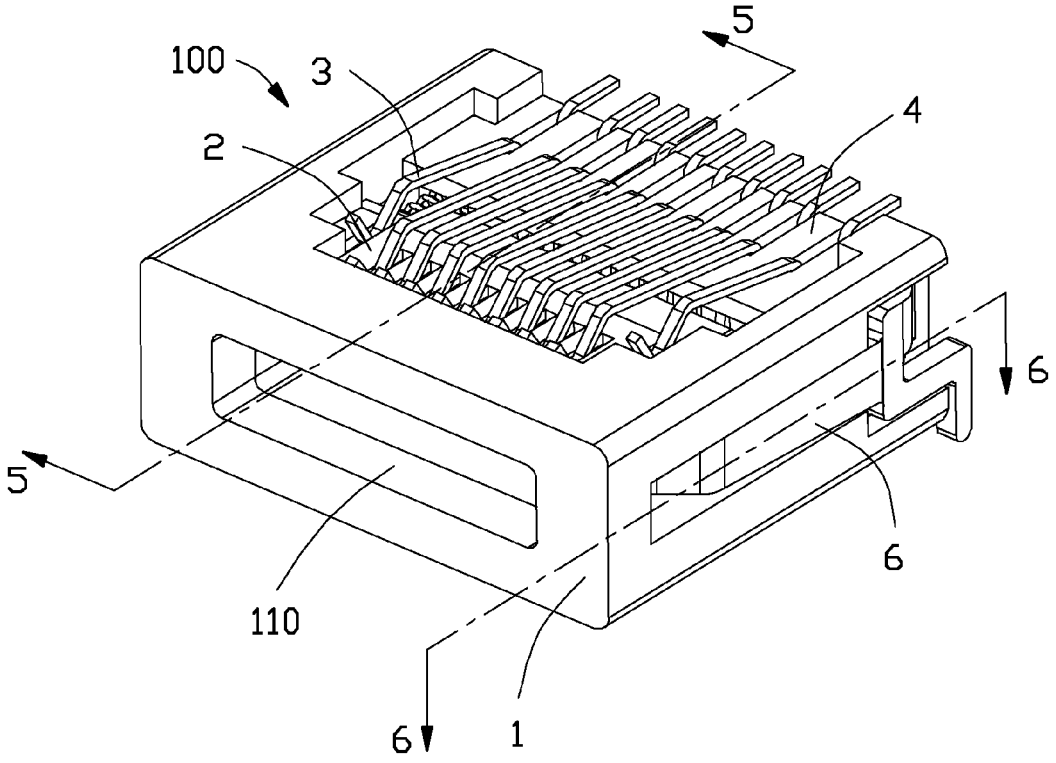
FIG. 1 is a perspective, assembled view of a receptacle connector in a first embodiment constructed in accordance with the present invention.
Figure 2:
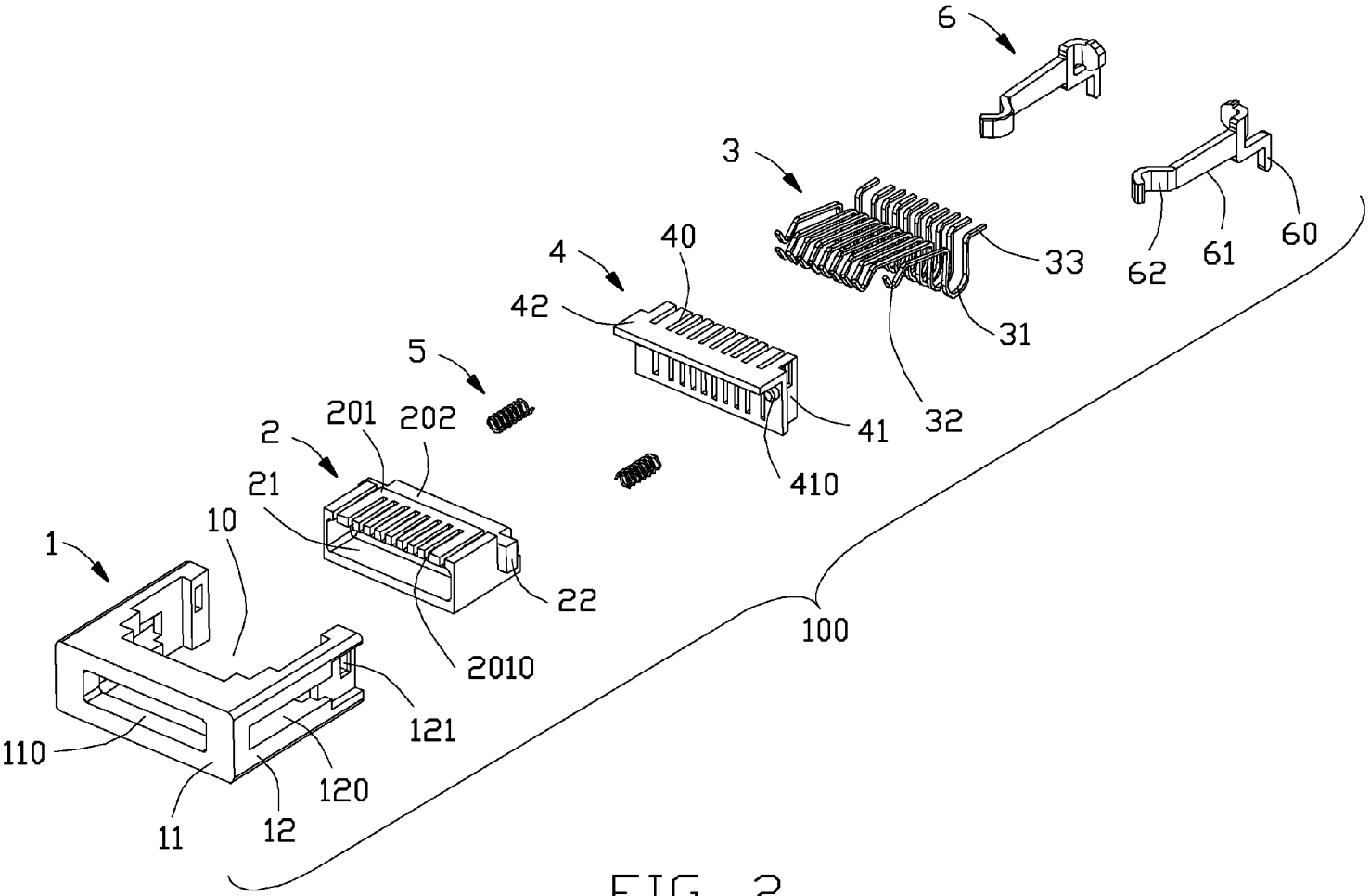
FIG. 2 is perspective, fully exploded view of the receptacle connector of FIG. 1.
Figure 3:
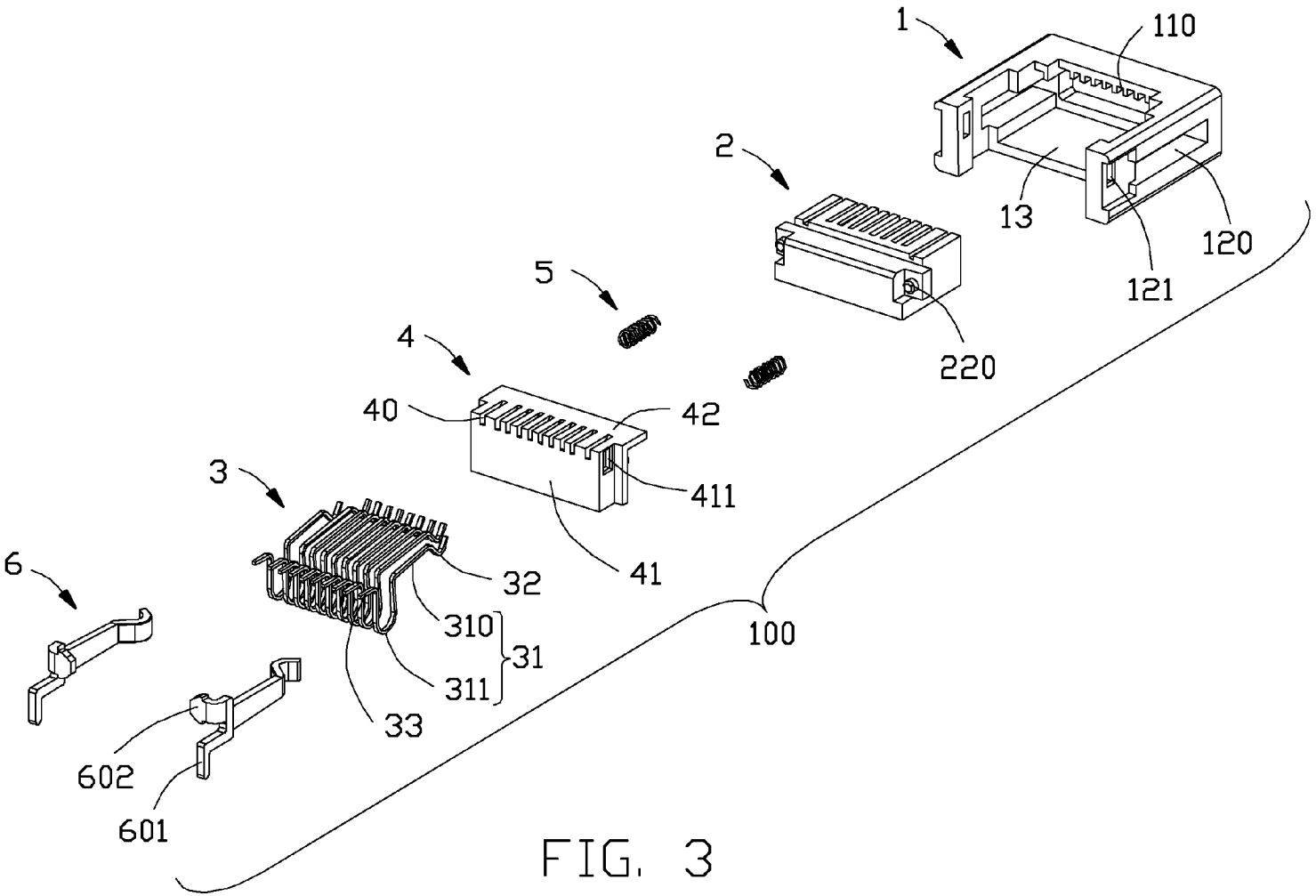
FIG. 3 is similar to FIG. 2, but taken from a different view.
Figure 4:
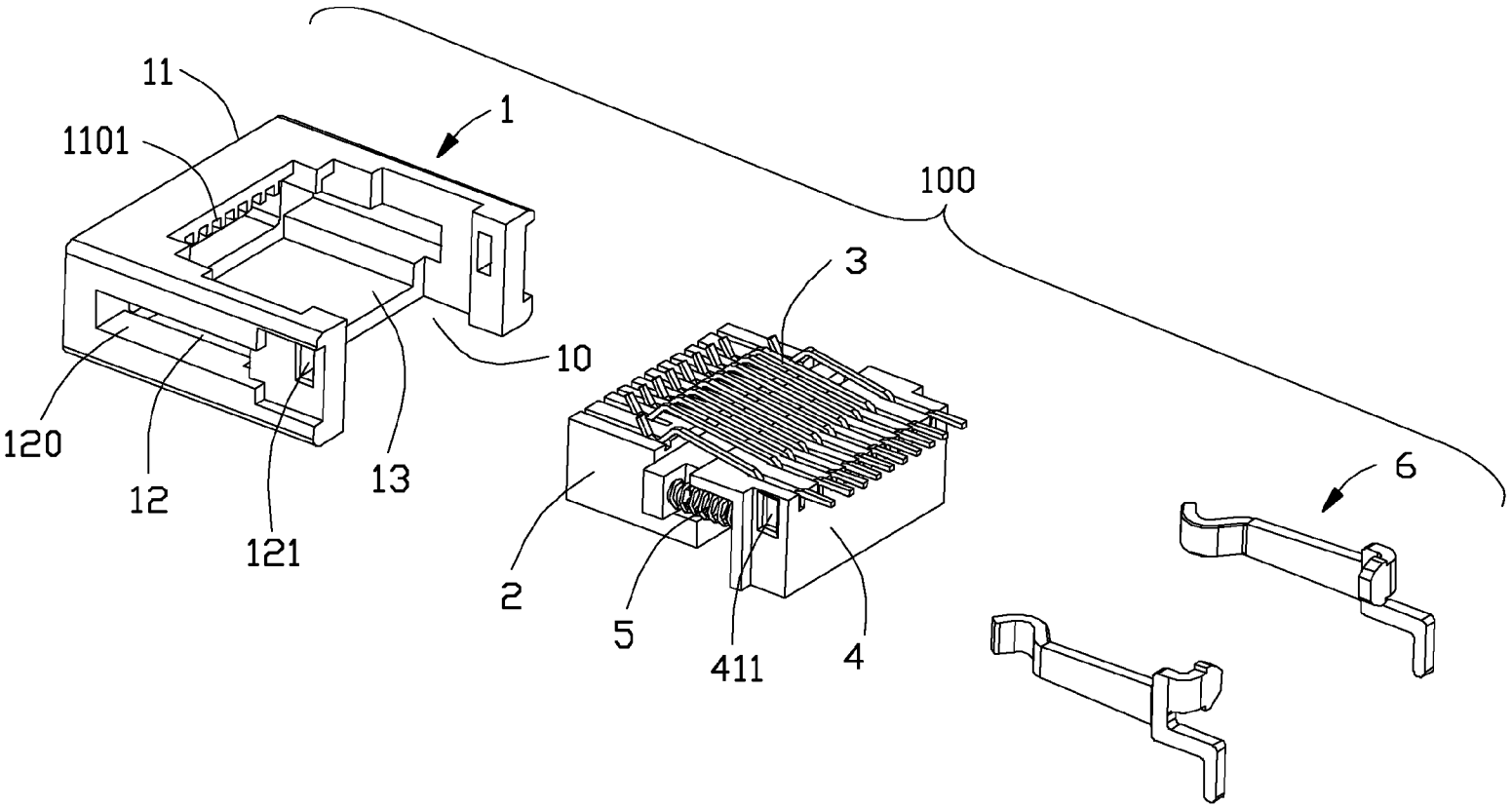
FIG. 4 is perspective, partly assembled view of the receptacle connector of FIG. 1.

Reference will now be made in detail to the preferred embodiment of the present invention.

Referring to FIGS. 1-9, a receptacle connector 100 in a first embodiment of the present invention, comprises an insulative housing 1, an insulative body 4 assembled to the insulative housing 1, a plurality of terminals 3 received in the insulative body 4, a slider 2 assembled between the insulative housing 1 and the insulative body 4, and a pair of springs 5 sandwiched between the slider 2 and the insulative body 4 for providing elasticity to the slider 2.

Referring to FIGS. 1-6, the insulative housing 1 defines an inner space or mating cavity 10 for receiving the plug connector along a front-and-rear direction. The insulative housing 1 comprises a main portion 11 extending along a transverse direction perpendicular to the front-and-rear direction, a pair of longitudinal arms 12 extending rearwardly from two distal ends of the main portion 11 along the front-and-rear direction, and a flat portion 13 extending rearwardly from a lower edge of the main portion 11 along the front-and-rear direction for connecting with the longitudinal arms 12 in a lower level. The main portion 11 defines an opening 110 communicating with the inner space 10. Each longitudinal arm 12 defines a slot 120 communicating with the inner space 10 and exterior. The slot 120 extends along the front-and-rear direction, too. The insulative housing 1 forms a plurality of ribs 1101 extending downwardly from an inner upper face of the main portion 11 into the opening 110. The insulative housing 1 defines an aperture 121 at a rear end of the longitudinal arm 12 and the aperture 121 is communicated with the inner space 10.

Referring to FIGS. 2-6, the slider 2 defines a channel 21 at a front thereof and a plurality of passageways 2010 at a top face 201 thereof The channel 21 is correspondingly communicated with the opening 110 along the front-and-rear direction. Each passageway 2010 is recessed from the top face 201 along a vertical direction perpendicular to both the front-and-rear direction and the transverse direction to be communicated with the channel 21. The slider 2 comprises a stepped face 202 located behind and lower than the top face 201. The slider 2 comprises a pair of protrusions 22 extending outwardly from two opposite lateral sides of the stepped faces 202. The slider 2 comprises a pair of first posts 220 spacing from each other along the transverse direction, each extending rearwardly from the corresponding sideward-extending protrusions 22 along the front-and-rear direction.

Referring to FIGS. 1-6, the insulative body 4 is reversed L-shaped when take along a lateral side view. The insulative body 4 comprise a vertical base portion 41 and a horizontal tongue portion 42 extending from a top end of the vertical base portion 41. The insulative body 4 defines a plurality of retaining holes 40 each extending a small distance from the top end thereof The insulative body 4 forms a pair of second posts 410 extending forwardly from the vertical base portion 41 along the front-and-rear direction and below the horizontal tongue portion 42. The second posts 410 are spaces from each other, too and correspondingly faces to the first posts 220 along the front-and-rear direction. The vertical base portion 41 defines a slit 411 at each lateral surface thereof The horizontal tongue portion 52 has an upper surface lower than the top face 201 of the slider 2 and a lower surface higher than the stepped portion 202.

Figure 5:
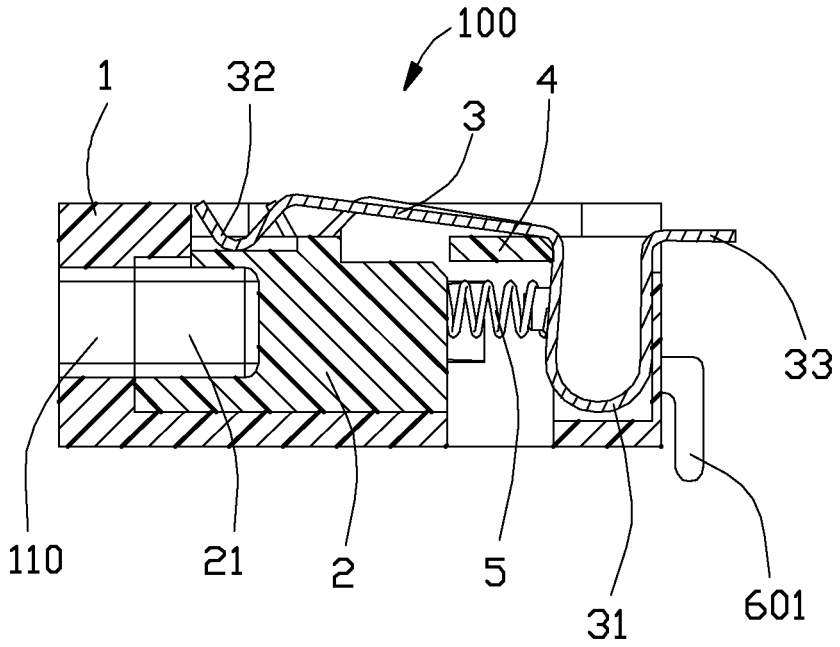
FIG. 5 is a cross-sectional view when taken along line 5-5 of FIG. 1.
Figure 6:
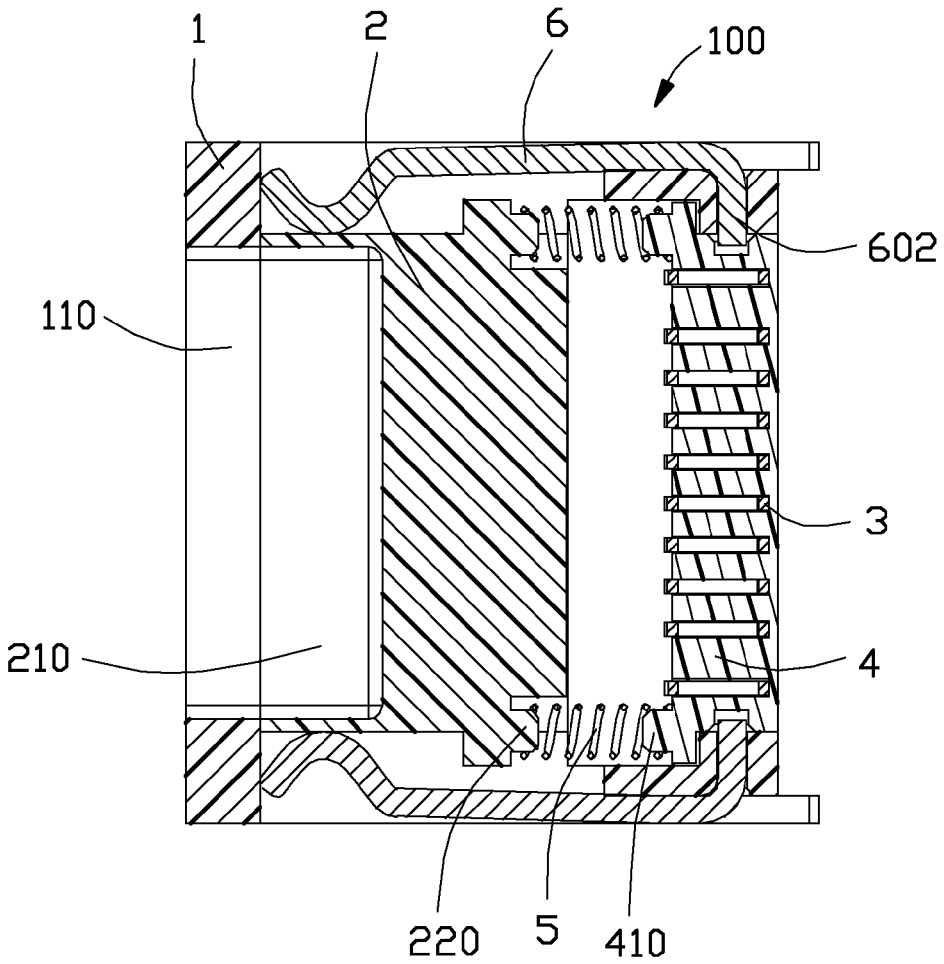
FIG. 6 is a cross-sectional view when taken along line 6-6 of FIG. 1.
Figure 7:
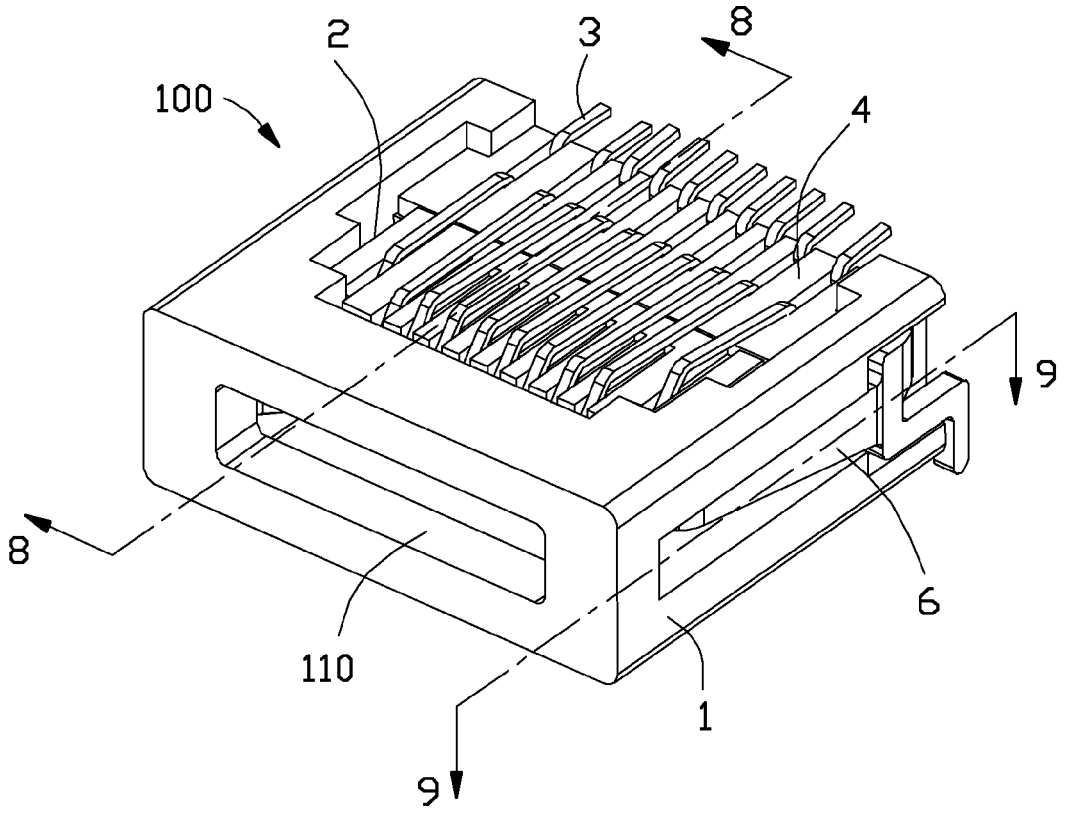
FIG. 7 is a perspective, assembled view of the receptacle connector and a mating plug connector inserted in the receptacle connector of FIG. 1.

Referring to FIGS. 1-6, particularly referring to FIG. 6, each terminal 3 comprises a curved portion 31, a contacting portion 32 extending forwardly from the curved portion 31, and a rear portion 33 extending backwardly from the curved portion 31. The curved portion 31 comprises a slantwise linear portion 311 connecting to the contacting portion 32 and a U-shaped portion 312 connecting to the rear portion 33. The slantwise linear portion 311 is supported on the insulative body 4 and the slider 2 to make sure that the contacting portion 32 is suspended upon the passageway 2010 of the slider 2. The rear portion 33 is exposed out of the insulative body 4 for soldering on a printed circuit board (not shown). The U-shaped portion 312 is received in the retaining hole 40 of the insulative body 4. The U-shaped portion 312 extends beyond the insulative body 4 from the front surface of the vertical base portion 41 to make sure that the slider 2 is capable of pressing against the U-shaped portion 312 along the front-and-rear direction.

Referring to FIGS. 1-6, the springs 5 are corresponding positioned by the first posts 220 and the second posts 410 so as to be sandwiched between the slider 2 and the insulative body 4 for providing elasticity.

Referring to FIGS. 1-6, the receptacle connector 100 further comprises a pair of latches 6. Each latch 6 comprises a retaining portion 60, a flexible beam 61 extending forwardly from the retaining portion 60, and a hook portion 62 formed at a front end of the flexible beam 61. The retaining portion 60 comprises a first retainer 601 extending downwardly and vertically for retaining the receptacle connector 100 in the printed circuit board and a second retainer 602 extending laterally and inwardly into the slit 411 and the aperture 121 for assembling the latch 6 on the insulative body 4 and the insulative housing 1. The flexible beam 61 is received in the slot 120 of the longitudinal arm 12. The latch 6 and the spring 5 are positioned two opposite sides of the longitudinal arm 12 along the transverse direction.

Referring to FIGS. 5 and 6, before the plug connector is inserted into the receptacle connector 100, the springs 6 are in nature estate to push the slider 2 at a front, original position adjacent to the insulative housing 1. The slider 2 blocks up the slots 120 of the insulative housing 1 for preventing water, dust, or etc from entering into the interior of electronic appliance via the opening 10 and the slot 120. The hook portions 62 of the latches 6 press against the lateral walls of the slider 2 and therefore, are prevented from entering into the inner space 10.

Figure 8:
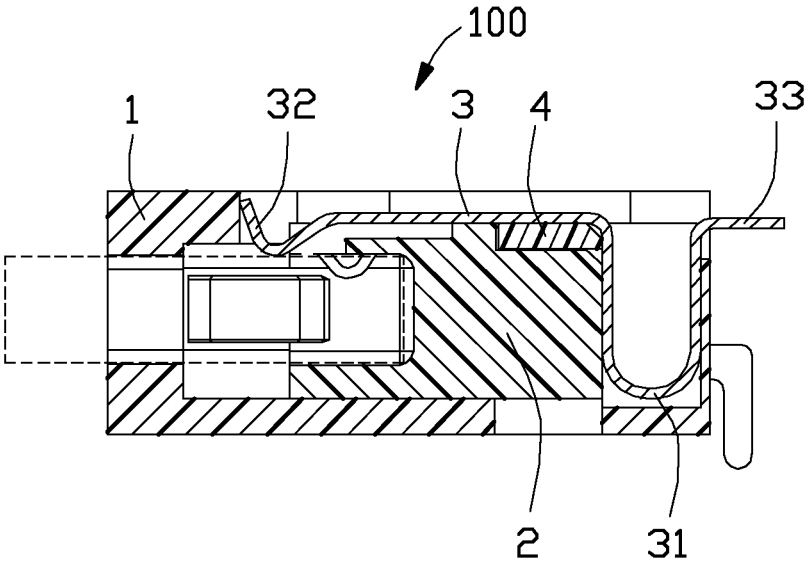
FIG. 8 is a cross-sectional view when taken along line 8-8 of FIG. 7.
Figure 9:
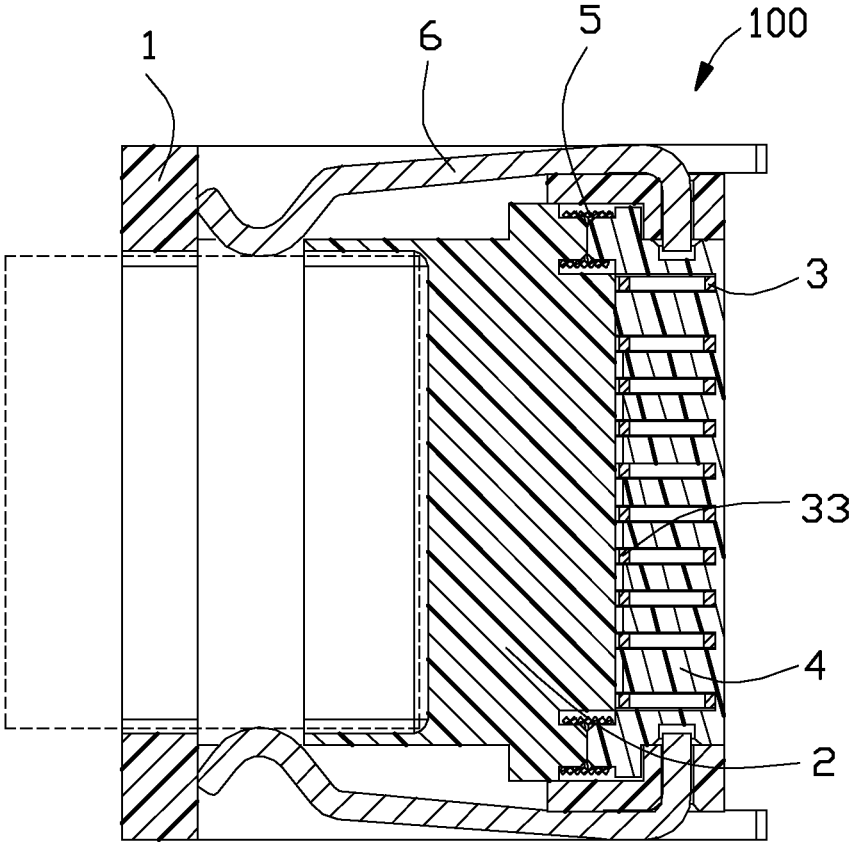
FIG. 9 is a cross-sectional view when taken along line 9-9 of FIG. 7.

Referring to FIGS. 8 and 9, after the plug connector is inserted into the inner space 10 of the receptacle connector 100 through the opening 110, the plug connector pushes the slider 2 to moves backwardly and the slider 2 actuates the springs 5 to deform and have elasticity. The slider 2 moves along the slot 120 from the front, original position to a back, final position at which the slot 120 is opened and the hook portions 62 of the latches 6 flexibly enter into the inner space 10 via the slot 120. During the movement of the slider 2 from the front, original position to the back, final position, the slider 2 presses against the U-shaped portions 312 for pulling the slantwise linear portions 311 downwardly and finally, the contacting portions 32 enter into the inner space 10 for engaging with the mating plug connector when the slider 2 moves to the back, final position. Because the plug connector is inserted in the inner space 10, namely the inner space 10 is filled with the plug connector, and therefore, prevents water, dust, or etc from entering into the interior of electronic appliance via the opening 10 and the slot 120 even though the slot 120 is opened.

Figure 10:
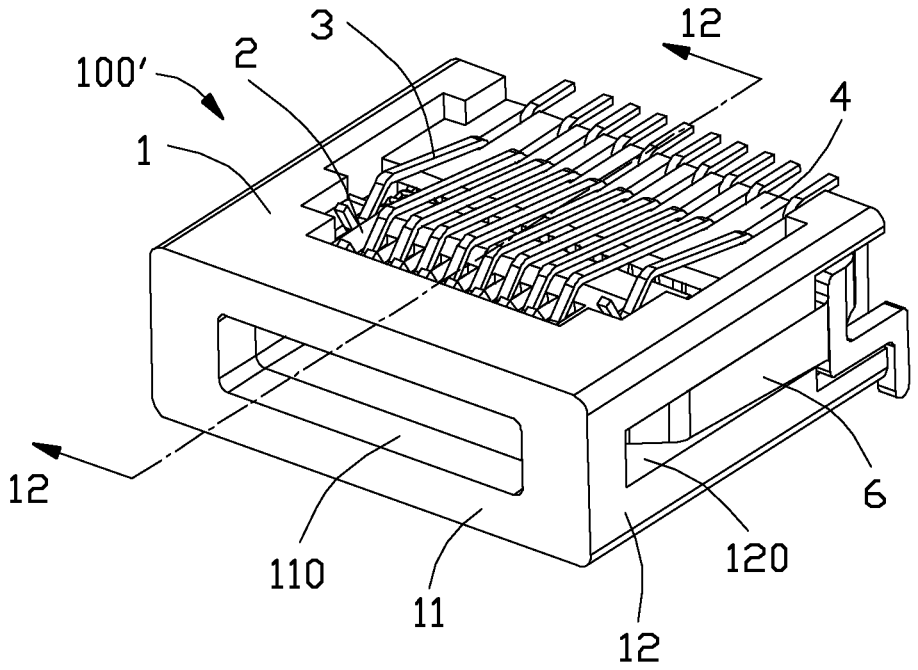
FIG. 10 is a perspective, assembled view of a receptacle connector in a first embodiment constructed in accordance with the present invention.
Figure 11:
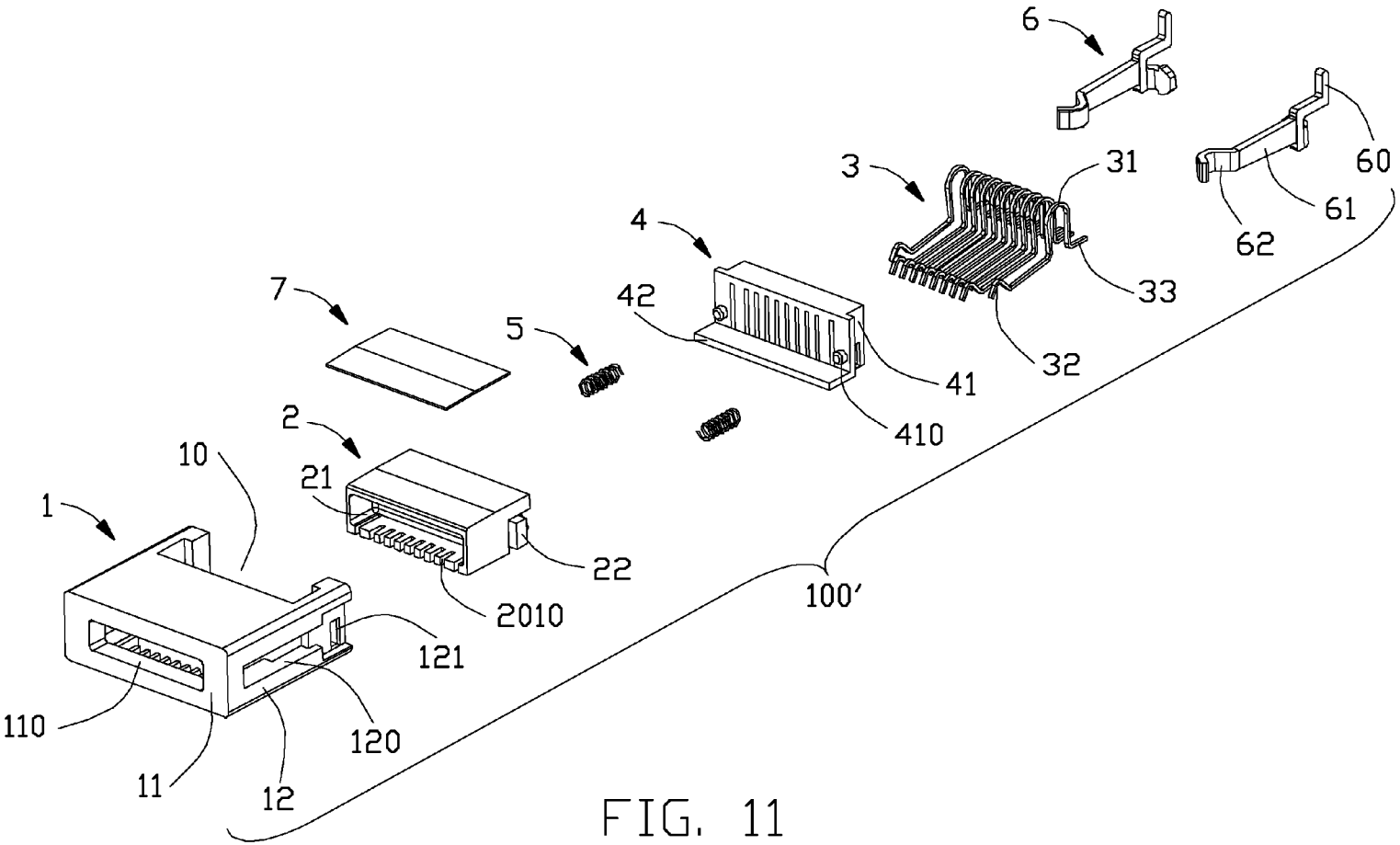
FIG. 11 is a cross-sectional view when taken along line 11-11 of FIG. 10.
Figure 12:
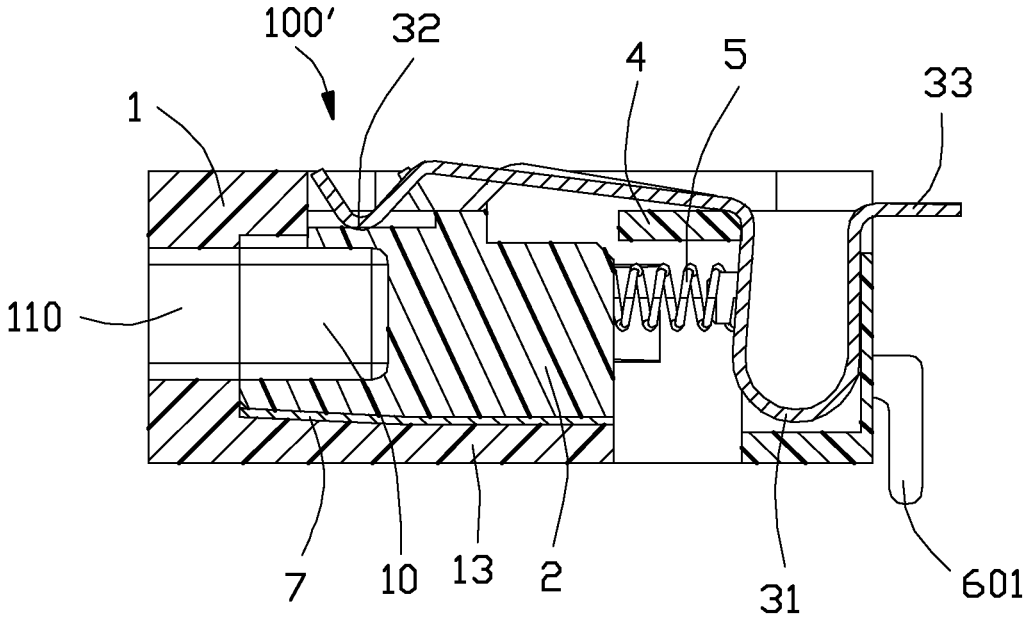
FIG. 12 is a cross-sectional view when taken along line 12-12 of FIG. 10.

Referring to FIGS. 10 to 12, a receptacle connector 100' in a second embodiment of the present invention, comprises an insulative housing 1, a insulative body 4 assembled to the insulative housing 1 and having a plurality of terminals 3, a slider 2 assembled between the insulative housing 1 and the insulative body 4, and a pair of springs 5 sandwiched between the slider 2 and the insulative body 4 for providing elasticity to the slider 2, and a pair of latches 6 integrating the insulative body 4' to the insulative housing 1. The receptacle connector 100' of the second embodiment is different from the receptacle connector 100 of the first embodiment in that the receptacle connector 100 of the second embodiment further comprises an additional pad 7. The pad 7 is substantially rectangular or other figures. The pad 7 is positioned between the slider 2 and the flat portion 13. The pad 7 provides elasticity to the slider 2 along the vertical direction for more effectively sealing gaps between the slider 2' and the insulative housing 1. Therefore, the receptacle connector 100' of the second embodiment has a more waterproof effect.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A receptacle connector comprising:

an insulative housing defining an inner space;

an insulative body assembled to the insulative housing;

a slider assembled between the insulative housing and the insulative body along a front-and-rear direction; and a plurality of terminals retained in the insulative body, each terminal having a contacting portion, a U-shaped portion, and a slantwise linear portion connecting between the contacting portion and the U-shaped portion, the U-shaped portion being retained in the insulative body and partly exposing out of the insulative body, the contacting portion being suspended upon the slider;

wherein the slider is moveable in the inner space from a front, original position to a back, final position with respect to the insulative housing to press against the U-shaped portions of the terminals, pull the slantwise linear portions downwardly, and enter the contacting portions into the inner space.

2. The receptacle connector as claimed in claim 1, further comprising a pair of latches securing the insulative body with the insulative housing.

3. The receptacle connector as claimed in claim 2, wherein the insulative body defines a slit at each of two lateral surface thereof, the insulative housing comprises a main portion and a pair of longitudinal arms extending backwardly from the main portion, each longitudinal arm defining an aperture, and each latch includes a retaining portion having a retainer extending into the slit and the aperture to assemble the insulative body to the insulative housing.

4. The receptacle connector as claimed in claim 3, wherein each longitudinal arm defines a slot, each latch has a flexible beam extending forwardly from the retaining portion and a hook portion formed at a front end of the flexible beam, and the hook portions press against the slider when the slider blocks off the slots at the front, original position and flexibly enter into the inner space via the slots when the slider goes away from the slots at the back, final position.

5. The receptacle connector as claimed in claim 3, further comprising a pair of springs between the slider and the insulative body for actuating the slider to return from the back, final position to the front, original position.

6. The receptacle connector as claimed in claim 5, wherein the latch and the spring are positioned at two opposite sides of a corresponding longitudinal arm along a transverse direction perpendicular to the front-and-rear direction.

7. The receptacle connector as claimed in claim 5, wherein the slider comprises a pair of first posts extending backwardly, the insulative body comprises a pair of second posts extending forwardly to face the first posts, and the springs are positioned by the first posts and the second posts.

8. A receptacle connector comprising:

an insulative housing having an inner space, a transverse main portion, and a pair of longitudinal arms extending backwardly from the main portion, each longitudinal arm defining a slot;

an insulative body assembled to the insulative housing;

a plurality of terminals retained in the insulative body;

a slider assembled between the insulative housing and the insulative body;

at least one spring sandwiched between the slider and the insulative body; and a pair of latches each having a retaining portion securing the insulative body to the insulative housing and a hook portion extending forwardly from the retaining portion;

wherein the slider is moveable from a front, original position to a back, final position to compress the at least one spring and to move the hook portions into the inner space via the slots along a transverse direction, and the slider is moveable by the at least one spring to return to the back, final position to sealingly block the slots.

9. The receptacle connector as claimed in claim 8, wherein the hooks press against the slider when the slider is positioned at the front, original position.

10. The receptacle connector as claimed in claim 8, wherein the latch and the spring are positioned at two opposite sides of a corresponding longitudinal arm along the transverse direction.

11. The receptacle connector as claimed in claim 8, wherein the terminals comprise a plurality of contacting portions protruding into the inner space from a vertical direction perpendicular to the transverse direction when the slider is at the back, final position.

12. A receptacle connector comprising:

an insulative housing defining a mating cavity forwardly communicating with an exterior along a front-to-back direction for receiving a plug;

a slider received and moveable within the housing between a first position and a second position;

a plurality of contacts associated with the housing, each of said contacts including a front contacting section and a rear mounting section; wherein when the slider is located at the first position, the slider completely seals the mating cavity to fully isolate the front contacting sections of the contacts from the mating cavity for waterproof consideration; when the slider is moved to the second position by the plug which is inserted into the mating cavity, the slider no longer isolates the contacting sections of the contacts from the mating cavity, and the contacting sections of the contacts move at least in a vertical direction perpendicular to said front-to-back direction to enter the mating cavity for connecting the plug.

13. The receptacle connector as claimed in claim 12, further including a spring device constantly urging the slider to move forwardly in the front-to-back direction.

14. The receptacle connector as claimed in claim 13, further including a latch device deflectable in a transverse direction perpendicular to both said front-to-back direction and said vertical direction to provide different feelings when the slider is located at the first position or the second position.

15. The receptacle connector as claimed in claim 14, further including a latch device which is isolated from the mating cavity when the slider is located at the first position while entering into the mating cavity when the slider is moved to the second position.

16. The receptacle connector as claimed in claim 12, wherein the contacting section of each of said contacts is deflected by the slider in the vertical direction when the slider is located at the first position, but is deflected by the plug in the vertical direction when the slider is moved to the second position by the plug.

17. The receptacle connector as claimed in claim 12, wherein slider is moveable along the front-to-back direction.

18. The receptacle connector as claimed in claim 17, wherein said first position is located in front of the second position in the front-to-back direction.

19. The receptacle connector as claimed in claim 12, further including an insulative body on which the contacts are retained; wherein the insulative body is attached to the housing.

20. The receptacle connector as claimed in claim 19, further including a spring device sandwiched between the insulative body and the slider in the front-to-back direction to provide restoration force so as to have the slider move between the first position and the second position.

* * * * *